US008350553B2

(12) United States Patent
Hirose et al.

(10) Patent No.: US 8,350,553 B2
(45) Date of Patent: Jan. 8, 2013

(54) REFERENCE VOLTAGE GENERATION CIRCUIT FOR SUPPLYING A CONSTANT REFERENCE VOLTAGE USING A LINEAR RESISTANCE

(75) Inventors: Tetsuya Hirose, Sapporo (JP); Tetsuya Asai, Sapporo (JP); Yoshihito Amemiya, Sapporo (JP); Kenichi Ueno, Sapporo (JP)

(73) Assignee: National University Corporation Hokkaido University, Sapporo-Shi (JP)

( * ) Notice: Subject to any disclaimer, the term of this patent is extended or adjusted under 35 U.S.C. 154(b) by 361 days.

(21) Appl. No.: 12/670,199

(22) PCT Filed: Jul. 16, 2008

(86) PCT No.: PCT/JP2008/062830

§ 371 (c)(1),
(2), (4) Date: Feb. 24, 2010

(87) PCT Pub. No.: WO2009/014042

PCT Pub. Date: Jan. 29, 2009

(65) Prior Publication Data

US 2010/0164461 A1 Jul. 1, 2010

(30) Foreign Application Priority Data

Jul. 23, 2007 (JP) ..... 2007-191106

(51) Int. Cl.
*G05F 3/16* (2006.01)
*G05F 1/00* (2006.01)

(52) U.S. Cl. ..... 323/313; 323/285

(58) Field of Classification Search ..... 323/285, 323/313

See application file for complete search history.

(56) References Cited

U.S. PATENT DOCUMENTS 5,512,817 A * 4/1996 Nagaraj ..... 323/316
6,157,245 A * 12/2000 Rincon-Mora ..... 327/539
6,831,505 B2 * 12/2004 Ozoe ..... 327/541

(Continued)

FOREIGN PATENT DOCUMENTS

JP 2002-099336 A 4/2002

OTHER PUBLICATIONS

European Search Report issued in European Application No. 08791225.9 dated Oct. 31, 2011.

(Continued)

*Primary Examiner* — Adolf Berhane
*Assistant Examiner* — Emily Pham
(74) *Attorney, Agent, or Firm* — Sughrue Mion, PLLC

(57) ABSTRACT

An object of the present invention is to generate a reference voltage that is stable in relation to manufacturing process variations, by matching the operating regions of the MOSFETs contributing to generation of the reference voltage. The reference voltage generation circuit 1 includes: a current mirror unit 2 that generates a current $I_P$ at current output terminals $P_{C1}$ to $P_{C5}$; a MOSFET **6*b* having a drain terminal connected to the current output terminal $P_{C2}$ side, a source terminal connected to ground side, and a gate terminal connected to a reference voltage output terminal $P_{OUT}$; a combined voltage generating unit 8 having two MOSFET pairs in which currents are generated at drain terminals from the current output terminals $P_{C3}$ to $P_{C5}$, source terminals are mutually connected, and a combined voltage with a positive temperature coefficient is generated; and a MOSFET 9 in which current is generated at a drain terminal from the current mirror unit 2, a gate terminal is connected to the input of the combined voltage generating unit 8**, a source terminal is connected to the ground side, and a voltage with a negative temperature coefficient is generated.

4 Claims, 9 Drawing Sheets

U.S. PATENT DOCUMENTS

| | | | | |
|---|---|---|---|---|
| 2003/0080807 | A1* | 5/2003 | Dasgupta et al. | 327/543 |
| 2006/0197585 | A1 | 9/2006 | Kim et al. | |
| 2008/0048634 | A1* | 2/2008 | Kotchkine et al. | 323/313 |

OTHER PUBLICATIONS

Toshihiro Matsuda e t al., "A Temperature and Supply Voltage Independent CMOS Voltage Reference Circuit", IEICE Trans. Electron., May 2005, pp. 1087-1093, vol. E88-C, No. 5.

Giuseppe De Vita et al., "A Sub-1-V, 10 ppm/ °C, Nanopower Voltage Reference Generator", IEEE Journal of Solid -State Circuits, Jul. 2007, pp. 1536-1542, vol. 42, No. 7.

Translation of the International Preliminary Report on Patentability of PCT/JP2008/062830 dated Feb. 18, 2010.

* cited by examiner (a)

(b)

PRIOR ART

REFERENCE VOLTAGE GENERATION CIRCUIT FOR SUPPLYING A CONSTANT REFERENCE VOLTAGE USING A LINEAR RESISTANCE

TECHNICAL FIELD

The present invention relates to a reference voltage generation circuit that supplies a constant reference voltage.

BACKGROUND ART

In the past, reference voltage generation circuits have been used as circuits for generating a reference voltage in circuits of AD converters, DA converters, op-amps, and regulators. These reference voltage generation circuits are generally known for outputting a reference voltage by referring to the silicon bandgap energy created by combining a bipolar transistor element or diode element with resistance. With such a reference voltage generation circuit, however, because an element other than a MOSFET is needed when it is configured on a Large Scale Integrated (LSI) circuit, the number of steps in the production process increases, and therefore operational matching tends to become very difficult. In addition, there arises a problem that power consumption tends to be relatively large, and the chip surface area must be increased to assure high resistance even in cases of operation at a low current.

To overcome these problems Non-patent Document 1 below has proposed a reference voltage generation circuit constructed only from MOSFETs without using a bipolar element and resistor element. This reference voltage generation circuit is one that generates a reference voltage by referring to the threshold voltage in the MOSFETs at the absolute zero temperature. More specifically, the circuit comprises a MOSFET that operates in the strong inversion-linear region in place of resistance, and also a MOSFET that operates in the strong inversion-saturation region, which generates the bias voltage of that MOSFET. The scaling in reference to the thermal voltage by the β multiplier referenced self-biasing circuit, and the equalized currents flowing through each current path of the circuit allow the MOSFET operating in the strong inversion-linear region to add the threshold voltage and the scaled voltage by thermal voltage to the output voltage and to output the same. A reference voltage generation circuit of such a configuration enables a circuit outputting a reference voltage with little fluctuation due to temperature to be constructed on an LSI.

Non-patent Document 1: T. MATSUDA, R. MINAMI, A. KANAMORI, H. IWATA, T. OHZONE, S. YAMAMOTO, T. IHARA, S. NAKAJIMA, "A Temperature and Supply Voltage Independent CMOS Voltage Reference Circuit", MICE TRANS. ELECTRON., Vol. E88-C, No. 5, pp. 1087-1093, May 2005.

DISCLOSURE OF INVENTION

Problems to be Solved by the Invention

However, the prior art reference voltage generation circuit discussed above operates so that the reference voltage is generated using MOSFETs with two different operating regions, and therefore mismatches occur in the operating parameters such as threshold voltage and carrier mobility, etc. In addition, the properties between the two MOSFETs change greatly in accordance with circuit design parameters, and stable reference voltage generation can be difficult to obtain.

Furthermore, because the generated reference voltage fluctuates in accordance with the currents generated in the plurality of circuit paths of the current mirror circuit, maintaining a constant reference voltage has been extremely difficult because of the effect of fluctuation in the power supply voltage, etc.

Therefore, with the foregoing in view, an object of the present invention is to provide a reference voltage generation circuit capable of generating a reference voltage that is stable with respect to process variations during manufacturing by matching the operating regions of the MOSFETs contributing to generation of the reference voltage.

Means for Solving the Problems

To solve the above problems, the reference voltage generation circuit of the present invention comprises: a current mirror unit supplied with a source voltage and generating a current at first to Nth (wherein N is an integer of 4 or more) current output terminals; a first field effect transistor operating as a linear resistance, and having a drain terminal connected to the second current output terminal side, a source terminal connected to ground side, and a gate terminal connected to a reference voltage output terminal; a combined voltage generating unit having one or more field effect transistor pairs in which currents are generated at drain terminals from any of the third to Nth current output terminals, source terminals are mutually connected, and a combined voltage with a positive temperature coefficient is generated between gate terminals, the field effect transistor pairs being connected in series between an input terminal and the reference voltage output terminal; and a second field effect transistor in which current is generated at a drain terminal from the third current output terminal, a gate terminal is connected to the input terminal of the combined voltage generating unit, a source terminal is connected on the ground side, and a voltage with a negative temperature coefficient is generated between the gate terminal and source terminal.

In accordance with such a reference voltage generation circuit, at each of the N current output terminals of the current mirror unit, a current is established that is determined by the circuit properties of the current mirror unit, the reference voltage output value, and the properties of the first field effect transistor operating as linear resistance, and due to the fact that the current is generated at the drain terminal of the field effect transistor pair of the combined voltage generating unit from the third to Nth current output terminals a combined voltage with a positive temperature coefficient is output between the input terminal of the combined voltage generating unit and the reference voltage output terminal. In addition, by generating a current from the third current output terminal to the drain terminal of the second field effect transistor, a voltage having negative temperature properties is output between the drain terminal and source terminal of the second field effect transistor. As a result, it is possible to output a constant voltage independent of temperature to the reference voltage output terminal by adjusting the circuit design parameters such as the aspect ratio, etc. of each field effect transistor. At that time, because the field effect transistor pair contributing to generation of the reference voltage and the second field effect transistor operate in the same operating region, a mismatch in operation parameters is unlikely to occur, and because the properties between field effect transistors do not fluctuate greatly in relation to design parameters, it is possible to generate a reference voltage that is stable with respect to temperature fluctuations. Additionally, it is possible to generate a stable reference voltage even if the output current of the current mirror unit fluctuates due to fluctuations in the power supply voltage, etc.

Effect of the Invention

In accordance with the reference voltage generation circuit of the present invention, it is possible to generate a reference voltage that is stable with respect to variations in the manufacturing process by matching up the operating regions of the MOSFETs contributing to generation of the reference voltage.

EXPLANATION OF REFERENCE NUMERALS

1, 101, 201 . . . reference voltage generation circuit, 2, 102 . . . current mirror unit, 8, 108 . . . combined voltage generating unit, 6*b* . . . first MOSFET, 9 . . . second MOSFET, 10 . . . third MOSFET, $P_{C1}$, $P_{C2}$, $P_{C3}$, $P_{C4}$, $P_{C5}$ . . . current output terminals, $P_{IN}$ . . . input terminal, $P_{OUT}$ . . . reference voltage output terminal, $V_{DD}$ . . . power supply voltage, $V_{REF}$ . . . reference voltage.

BEST MODE FOR CARRYING OUT THE INVENTION

A preferred embodiment of the reference voltage generation circuit of the present invention is described in detail below with reference to the drawings. In the explanation of the drawings identical reference numbers refer to identical or corresponding parts, and duplicate explanations are omitted.

Figure 1:
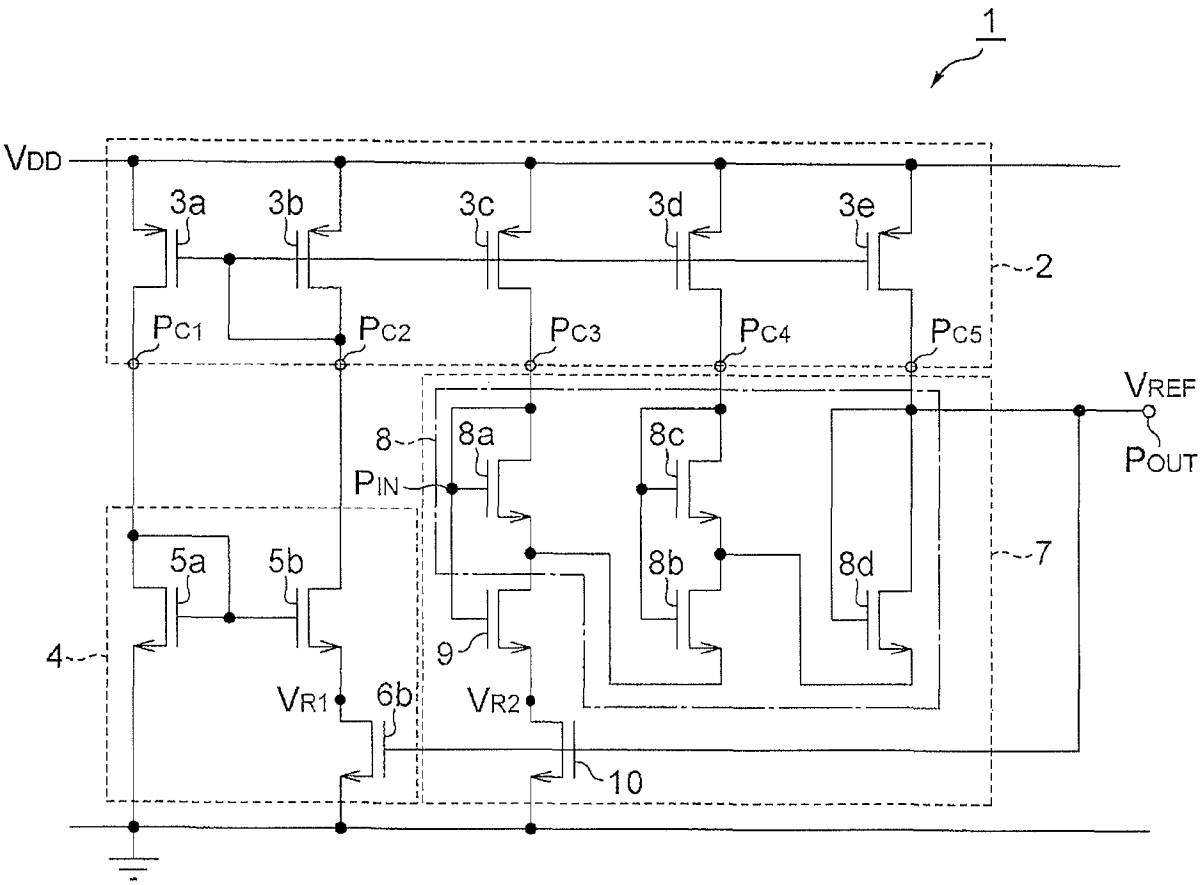
FIG. 1 is a circuit diagram showing the reference voltage generation circuit of a preferred embodiment of the present invention.

FIG. 1 is a circuit diagram showing the reference voltage generation circuit 1 of a preferred embodiment of the present invention. The reference voltage generation circuit 1 is the power supply circuit generating a reference voltage comprising MOS type field effect transistors (MOSFET) formed on an LSI.

As shown in the drawing, the reference voltage generation circuit 1 has a current mirror unit 2 that generates a current at five current output terminals $P_{C1}$, $P_{C2}$, $P_{C3}$, $P_{C4}$, $P_{C5}$. The current mirror unit 2 consists of five identically sized (channel length, channel width) P-type MOSFETs 3*a*, 3*b*, 3*c*, 3*d*, 3*e*. A power supply voltage $V_{DD}$ is provided to the source terminal of each MOSFET 3*a*, 3*b*, 3*c*, 3*d*, 3*e*, and a gate terminal is commonly connected to the drain terminal of MOSFET 3*b*. In addition, the drain terminal of each MOSFET 3*a*, 3*b*, 3*c*, 3*d*, 3*e* is connected, respectively, to current output terminals $P_{C1}$, $P_{C2}$, $P_{C3}$, $P_{C4}$, $P_{C5}$. Such a reference voltage generation circuit 1 provides an essentially equivalent, constant current $I_P$ to each of the five current output terminals $P_{C1}$, $P_{C2}$, $P_{C3}$, $P_{C4}$, $P_{C5}$.

A current source circuit unit 4 that draws current from the current mirror unit 2 is connected to the first current output terminal $P_{C1}$ and the second current output terminal $P_{C2}$ of the current mirror unit 2, and this current source circuit unit 4 contains three N-type MOSFETs 5*a*, 5*b*, and 6*b*. The drain terminals of MOSFETs 5*a* and 5*b* are connected to the first current output terminal $P_{C1}$ and the second current output terminal $P_{C2}$, respectively, and the respective gate terminals thereof are commonly connected to the drain terminal of MOSFET 5*a*. The source terminal of MOSFET 5*a* is connected to ground. Additionally, the drain terminal of MOSFET 6*b*, which operates as linear resistance, is connected to the second current output terminal $P_{C2}$ via MOSFET 5*b* by connecting it to the source terminal of MOSFET 5*b*, the source terminal thereof is connected to ground, and the gate terminal thereof is connected to the reference voltage output terminal $P_{OUT}$. The reference voltage output terminal $P_{OUT}$ is the output terminal for obtaining the final reference voltage from the reference voltage generation circuit 1.

In a current source circuit unit 4 with the above configuration, the power supply voltage $V_{DD}$ and the size of each FET are set so that MOSFETs 5*a*, 5*b* operate in the subthreshold region on the gate to source voltage and operate in the saturation region on the drain to source voltage (hereinafter, called "subthreshold-saturation region"). On the other hand, in MOSFET 6*b* they are established so that MOSFET 6*b* operates in the strong inversion region on the gate to source voltage and operates in the linear region on the drain to source voltage (hereinafter, called "strong inversion-linear region"). The current source circuit 4 operates so that a current $I_P$ determined by the properties of transistors 5*a*, 5*b*, and 6*b* will be drawn from the first current output terminal $P_{C1}$ and the second current output terminal $P_{C2}$ of the current mirror unit 2.

In this case the current-voltage characteristics of the MOSFET in the strong inversion-linear region are expressed by Formula (1) below.

[Mathematical Formula 1]

$$I_D = K_\beta \beta (V_{GS} - V_{TH}) V_{DS} - \frac{1}{2} V_{DS}^2 \tag{1}$$

In this case, $I_D$ represents the drain current, $K_\beta\beta$ represents the current gain coefficient, $K_\beta$ represents the MOSFET aspect ratio W (channel width/L (channel length)), $V_{GS}$ represents the gate-source voltage, $V_{TH}$ represents the threshold voltage, and $V_{DS}$ represents the drain-source voltage. In particular, when $V_{DS}$ is sufficiently small, the higher-order term of $V_{DS}$ can be ignored, and Formula (1) is approximated by Formula (2) below.

[Mathematical Formula 2]

$$I_D K_\beta \beta (V_{GS} - V_{TH}) V_{DS} \tag{2}$$

On the other hand, the current-voltage characteristics of the MOSFETs in the subthreshold region are represented by Formula (3) below.

[Mathematical Formula 3]

$$I_D = K I_0 \exp\left(\frac{V_{GS} - V_{TH}}{\eta V_T}\right)\left(1 - \exp\left(-\frac{V_{DS}}{V_T}\right)\right), \quad I_0 = \mu C_{OX} V_T^2 (\eta - 1) \tag{3}$$

In this case, K represents the FET aspect ratio (=W (channel width)/L (channel length)), $I_o$ represents the subthreshold current pre-coefficient, $V_T$ (=$k_B$T/q) represents the thermal voltage, $k_B$ represents the Boltzmann constant, T represents absolute temperature, q represents elementary charge, η represents the subthreshold slope coefficient, μ represents mobility, and $C_{OX}$ represents capacity per unit area of the oxide film. The subthreshold current $I_D$ becomes independent of the drain to source voltage $V_{DS}$ in a saturation region having a drain voltage of 4×$V_T$ (~0.1 V) or more, and is calculated by Formula (4) below.

[Mathematical Formula 4]

$$I_D = K I_0 \exp\left(\frac{V_{GS} - V_{TH}}{\eta V_T}\right) \tag{4}$$

Because from the above formula the difference in gate to source voltage of MOSFETs 5*a* and 5*b* becomes the drain voltage $V_{R1}$ of MOSFET 6*b*, which operates in the strong inversion-linear region, $V_{R1}$ becomes Formula (5) below.

[Mathematical Formula 5]

$$V_{R1} = V_{GS1} - V_{GS2} = \eta V_T \ln\left(\frac{K_2}{K_1}\right) \tag{5}$$

Therefore, based on the properties of MOSFET 6*b*, the current $I_P$ generated by the current mirror unit 2 is represented by Formula (6) below.

[Mathematical Formula 6]

$$I_P = K_\beta \beta (V_{REF} - V_{TH}) V_{R1} = K_\beta \beta (V_{REF} - V_{TH}) \eta V_T \ln\left(\frac{K_2}{K_1}\right) \tag{6}$$

In the formula, $K_1$ and $K_2$ represent the respective aspect ratios of MOSFETs 5*a* and 5*b*, and $V_{REF}$ is the reference voltage output from the reference voltage output terminal $P_{OUT}$.

The voltage source circuit unit 7 that generates the reference voltage $V_{REF}$ based on the current $I_P$ flowing from the current mirror unit 2 is connected to the third to fifth current output terminals $P_{C3}$, $P_{C4}$, $P_{C5}$ of the current mirror unit 2. This voltage source circuit unit 7 contains a combined voltage generating unit 8 comprising two pairs of N-type MOSFETs, and two N-type MOSFETs 9, 10.

The combined voltage generating unit 8 is formed by the MOSFET pair composed of two MOSFETs 8*a* and 8*b*, and the MOSFET pair composed of two MOSFETs 8*c* and 8*d* connected in series between the input terminal $P_{IN}$ and the output terminal $P_{OUT}$ of the reference voltage $V_{REF}$. More specifically, the source terminals of MOSFETs 8*a* and 8*b* constituting one MOSFET pair are mutually connected, the gate terminal of MOSFET 8*a* is connected to the input terminal $P_{IN}$, and the gate terminal of MOSFET 8*b* is connected to the output terminal $P_{OUT}$ side via the other MOSFET pair. In addition, the source terminals of MOSFETs 8*c* and 8*d* constituting the other MOSFET pair are mutually connected, the gate terminal of MOSFET 8*c* is connected to the input terminal $P_{IN}$ side via one of the MOSFET pairs, and the gate terminal of MOSFET 8*d* is connected to the output terminal $P_{OUT}$.

A drain current $I_P$ is generated by connecting the respective drain terminals of the three MOSFETs 8*a*, 8*c*, and 8*d* to the current output terminals $P_{C3}$, $P_{C4}$ and $P_{C5}$, and in MOSFET 8*b* a drain current 2×$I_P$ is generated due to the fact that the drain terminal is connected to the current output terminals $P_{C4}$ and $P_{C5}$ via MOSFETs 8*c* and 8*d*. Additionally, the gate terminals of MOSFETs 8*a*, 8*b*, 8*c*, and 8*d* are connected respectively to the current output terminals $P_{C3}$, $P_{C4}$, $P_{C4}$, and $P_{C5}$, and operate in the subthreshold-saturation region because the source voltage $V_{DD}$ and the size of each FET have been suitably set.

A combined voltage generating unit 8 with the above configuration can generate a combined voltage with a positive temperature coefficient between the two gate terminals of each MOSFET pair in accordance with the current $I_P$ provided from the current mirror unit 2. At that time, the threshold voltages that appear between the gate and source of each MOSFET will be mutually canceled out in the combined voltage that the MOSFET pairs generate.

In MOSFET 9, a drain current 3×$I_P$ is supplied from the current output terminals $P_{C3}$, $P_{C4}$, and $P_{C5}$ due to the fact that the drain terminals are connected on the side of the current output terminals $P_{C3}$, $P_{C4}$, and $P_{C5}$ via four MOSFETs 8*a*, 8*b*, 8*c*, and 8*d*. In addition, the source terminal of MOSFET 9 is connected on the ground side via MOSFET 10. Furthermore, the gate terminal of MOSFET 9 is connected to the input terminal $P_{IN}$ and the current output terminal $P_{C3}$, and MOSFET 9 operates in the subthreshold-saturation region by suitably setting the source voltage $V_{DD}$ and the size of each FET. MOSFET 9 can generate a voltage with a negative temperature coefficient between the input terminal $P_{IN}$ to which the gate terminal is connected and the source terminal.

The drain terminal of MOSFET 10 is connected to the source terminal of MOSFET 9, the source terminal is connected to ground, and the gate terminal is connected to the reference voltage output terminal $P_{OUT}$. MOSFET 10 operates as a linear resistance that can generate a voltage having a positive temperature coefficient between the drain and source because the drain current 3×$I_P$ is supplied from the current output terminals $P_{C3}$, $P_{C4}$ and $P_{C5}$, and it operates in the strong inversion-linear region.

In this case, because the reference voltage $V_{REF}$ generated at the reference voltage output terminal $P_{OUT}$ is obtained by adding or subtracting the gate to source voltages of MOSFETs 8*a*, 8*b*, 8*c*, 8*d*, and 9 operating in the subthreshold-saturation region to or from the drain voltage $V_{R2}$ of MOSFET 10, it is given by Formula (7) below.

[Mathematical Formula 7]

$$V_{REF} = V_{R2} + V_{GS4} - V_{GS3} + V_{GS6} - V_{GS5} + V_{GS7} \tag{7}$$

In this formula $V_{GS3}$, $V_{GS4}$, $V_{GS5}$, $V_{GS6}$ and $V_{GS7}$ are the respective gate to source voltages of MOSFET 8*a*, MOSFET 9, MOSFET 8*c*, MOSFET 8*b*, and MOSFET 8*d*. When one notices that the drain current flowing to MOSFET 10 of the strong inversion-linear region becomes $3\times I_P$, the drain voltage $V_{R2}$ of MOSFET 10 is represented by Formula (8) below.

[Mathematical Formula 8]

$$3I_P = K_\beta \beta (V_{REF} - V_{TH}) V_{R2} \tag{8}$$

Therefore, the drain voltage $V_{R2}$ is calculated by Formula (9) below using Formulas (6) and (8).

[Mathematical Formula 9]

$$\begin{aligned} V_{R2} &= \frac{3I_P}{K_\beta \beta (V_{REF} - V_{TH})} \\ &= \frac{3K_\beta \beta (V_{REF} - V_{TH})}{K_\beta \beta (V_{REF} - V_{TH})} \eta V_T \ln\left(\frac{K_2}{K_1}\right) \\ &= \eta V_T \ln\left(\frac{K_2^3}{K_1^3}\right) \end{aligned} \tag{9}$$

As a result, when Formulas (4) and (9) are used, the following substitution can be made in Formula (7).

[Mathematical Formula 10]

$$\begin{aligned} V_{REF} &= \frac{\eta V_T \ln\left(\frac{K_2^3}{K_1^3}\right)}{(V_{R2})} + \frac{V_{TH} + \eta V_T \ln\left(\frac{3I_P}{K_4 I_0}\right)}{(V_{GS4})} + \\ &\quad \frac{\eta V_T \ln\left(\frac{2K_3}{K_6}\right)}{(V_{GS6} - V_{GS3})} + \frac{\eta V_T \ln\left(\frac{K_5}{K_7}\right)}{(V_{GS7} - V_{GS5})} \\ &= \frac{V_{TH} + \eta V_T \ln\left(\frac{3I_P}{K_4 I_0}\right)}{(V_{GS4})} + \\ &\quad \frac{\eta V_T \ln\left(\frac{2K_2^3 K_3 K_5}{K_1^3 K_6 K_7}\right)}{(V_{R2} + V_{GS6} - V_{GS3} + V_{GS7} - V_{GS5})} \end{aligned} \tag{10}$$

In this formula, $K_3$ to $K_7$ represent the aspect ratios of MOSFETs 8*a*, 9, 8*c*, 8*b*, and 8*d*. Thus, the reference voltage $V_{REF}$ depends on the value obtained by scaling the gate to source voltage $V_{GS4}$ of MOSFET 9 and the thermal voltage $V_T$ with transistor sizes $K_1$ to $K_7$. The third and fourth terms of Formula (10) above indicate voltages across the gate terminals of the two MOSFET pairs of the combined voltage generating unit 8.

Next, the temperature properties of the reference voltage $V_{REF}$ will be considered. In general, the temperature dependence of the threshold voltage $V_{TH}$ and the mobility $\mu$ are expressed by Formulas (11) and (12) below.

[Mathematical Formula 11]

$$V_{TH} = V_{TH0} - \kappa T \tag{11}$$

[Mathematical Formula 12]

$$\mu = \mu_0 \left(\frac{T_0}{T}\right)^m \tag{12}$$

In this case, $V_{TH0}$ represents the threshold voltage at absolute zero temperature, $\kappa$ represents the threshold voltage temperature coefficient, T represents the absolute temperature, $\mu_0$ represents the mobility at $T_0$, and m represents the temperature coefficient of mobility. Thereby, the derivative temperature coefficient of the reference voltage $V_{REF}$ is expressed by Formula (13) below.

[Mathematical Formula 13]

$$\frac{dV_{REF}}{dT} = \frac{dV_{TH}}{dT} + \frac{d}{dT}\left(\eta V_T \ln\left(\frac{3I_P}{K_4 I_0}\right)\right) + \frac{d}{dT}\left(\eta V_T \ln\left(\frac{2K_2^3 K_3 K_5}{K_1^3 K_6 K_7}\right)\right) \tag{13}$$

When Formula (13) is rearranged using Formula (6), the relationship shown in Formula (14) below is obtained.

[Mathematical Formula 14]

$$\begin{aligned} \frac{dV_{REF}}{dT} &= -\kappa + \frac{\eta V_T}{T} \ln\left(\frac{3K_\beta \beta (V_{REF} - V_{TH})}{K_4 I_0} \eta V_T \ln\left(\frac{K_2}{K_1}\right)\right) + \\ &\quad \eta V_T \left(\frac{1}{V_{REF} - V_{TH}} \frac{dV_{REF}}{dT} + \frac{\kappa}{V_{REF} - V_{TH}} - \frac{1}{T}\right) + \\ &\quad \frac{\eta V_T}{T} \ln\left(\frac{2K_2^3 K_3 K_5}{K_1^3 K_6 K_7}\right) \end{aligned} \tag{14}$$

In the formula, when either $\eta V_T$ or the difference between the reference voltage $V_{REF}$ and the threshold voltage at absolute zero temperature $V_{TH0}$ is sufficiently smaller than $\kappa T$, i.e., it can be assumed that $\eta V_T \ll \kappa T$, $V_{REF} - V_{TH0} \ll \kappa T$, Formula (15) below is obtained from Formula (14) above.

[Mathematical Formula 15]

$$\frac{dV_{REF}}{dT} = -\kappa + \frac{\eta V_T}{T} \ln\left(\frac{\kappa T}{V_T} \frac{6\eta K_\beta K_2^3 K_3 K_5}{(\eta - 1) K_1^3 K_4 K_6 K_7} \ln\left(\frac{K_2}{K_1}\right)\right) \tag{15}$$

Therefore, by setting each aspect ratio K, which is a circuit design parameter, as in Formula (16) below, it is possible to make the temperature coefficient of the reference voltage $V_{REF}$ equal to zero.

[Mathematical Formula 16]

$$\frac{\eta V_T}{T} \ln\left(\frac{\kappa T}{V_T} \frac{6\eta K_\beta K_2^3 K_3 K_5}{(\eta - 1) K_1^3 K_4 K_6 K_7} \ln\left(\frac{K_2}{K_1}\right)\right) = \kappa \tag{16}$$

The reference voltage $V_{REF}$ at this time is expressed by Formula (17) below in a case where $\eta V_T \ll \kappa T$, and $V_{REF} - V_{TH0} \ll \kappa T$.

[Mathematical Formula 17]

$$\begin{aligned} V_{REF} &= V_{TH0} + \eta V_T \ln\left(1 + \frac{V_{REF} - V_{TH0}}{\kappa T}\right) \\ &= V_{TH0} + \eta V_T \frac{V_{REF} - V_{TH0}}{\kappa T} \\ &= V_{TH0} \end{aligned} \tag{17}$$

According to the formula, it is clear that the reference voltage $V_{REF}$ is essentially equal to the threshold voltage $V_{TH0}$ at absolute zero temperature. In addition, the current $I_P$ generated by the current mirror unit 2 at this time is expressed from Formula (16) in Formulas (18) and (19) below, and becomes a current referring to the subthreshold current pre-coefficient $I_0$.

[Mathematical Formula 18]

$$I_P = \beta(\eta V_T)^2 \ln\left(\frac{\kappa T}{V_T}\frac{6\eta K_\beta K_2^3 K_3 K_5}{(\eta-1)K_1^3 K_4 K_6 K_7}\ln\left(\frac{K_2}{K_1}\right)\right)\ln\left(\frac{K_2}{K_1}\right) = AI_0 \quad (18)$$

[Mathematical Formula 19]

$$A = \frac{K_\beta \eta^2}{\eta-1}\ln\left(\frac{\kappa T}{V_T}\frac{6\eta K_\beta K_2^3 K_3 K_5}{(\eta-1)K_1^3 K_4 K_6 K_7}\ln\left(\frac{K_2}{K_1}\right)\right)\ln\left(\frac{K_2}{K_1}\right) \quad (19)$$

From the above discussion, the reference voltage $V_{REF}$ generated by the reference voltage generation circuit 1 becomes one wherein the voltage having a positive temperature coefficient generated by the two MOSFET pairs of the combined voltage generating unit 8, the voltage having a positive temperature coefficient generated by MOSFET 10, and the voltage having a negative temperature coefficient generated by MOSFET 9 are combined, and this enables setting conditions wherein the temperature coefficient becomes zero because these temperature coefficients are canceled out.

According to the reference voltage generation circuit 1 disclosed above, a current $I_P$ determined by the circuit properties of the current mirror unit 2, the reference voltage output value $V_{REF}$, and the properties of MOSFET 6*b* that acts as a linear resistance, is set at each of the five current output terminals $P_{C1}$, $P_{C2}$, $P_{C3}$, $P_{C4}$, and $P_{C5}$ of the current mirror unit 2, and by generating current $I_P$ at the drain terminals of the MOSFET pairs of the combined voltage generating unit 8 from the third to fifth current output terminals $P_{C3}$, $P_{C4}$, and $P_{C5}$, or a current whereon the current $I_P$ is superposed, a composite voltage $V_{GS6}-V_{GS3}+V_{GS7}-V_{GS5}$ with a positive temperature coefficient is generated between the input terminal $P_{IN}$ of the combined voltage generating unit 8 and the reference voltage output terminal $P_{OUT}$. In addition, because the current $3\times I_P$ is generated from the third to fifth current output terminals $P_{C3}$, $P_{C4}$, and $P_{C5}$ at the drain terminal of MOSFET 9, a voltage $V_{GS4}$ having negative temperature properties is output between the drain terminal and the source terminal of MOSFET 9. Thus, by adjusting the circuit design parameters such as the MOSFET aspect ratio, etc., it is possible to output a temperature independent constant voltage to the reference voltage output terminal $P_{OUT}$. At this time, because the MOSFET pairs contributing to the generation of the reference voltage $V_{REF}$ and MOSFET 9 are operating in the same operating regions, a mismatch in operating parameters is unlikely to occur, and because the properties among the MOSFETs with respect to design parameters do not vary greatly, it is possible to generate a reference voltage $V_{REF}$ that is stable in relation to temperature changes.

Figure 9:
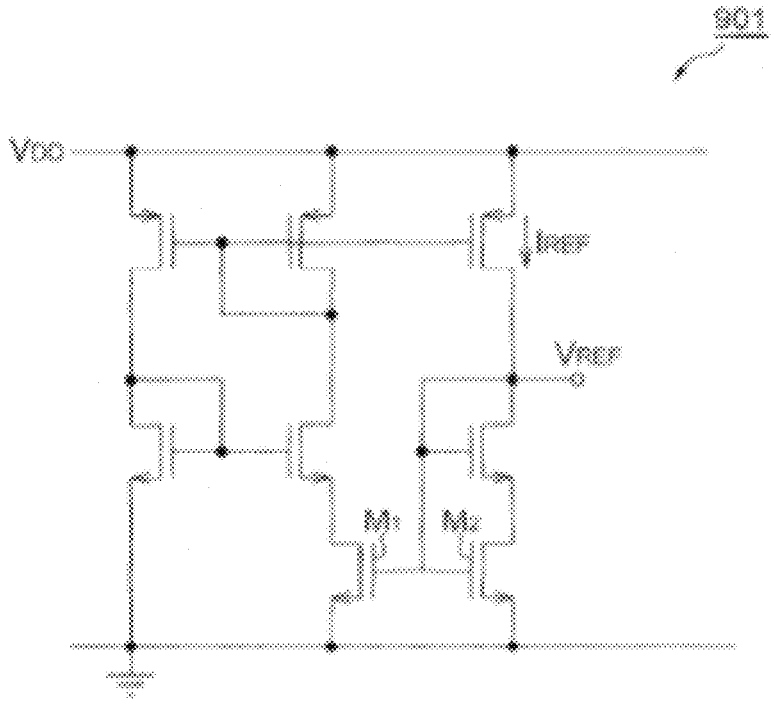
FIG. 9 is a circuit diagram showing a prior art example of a reference voltage generation circuit.

Additionally, even if the output current $I_F$ of the current mirror unit 2 varies due to fluctuations in the source voltage $V_{DD}$, etc., the reference voltage generation circuit enables the generation of a stable reference voltage $V_{REF}$. The prior art reference voltage generation circuit 901 shown in FIG. 9 has a structure wherein a MOSFET $M_1$ operating in the strong inverse-linear region and MOSFET $M_2$ operating in the strong inverse-saturation region are connected to two current output paths of the current mirror unit. The reference voltage $V_{REF}$ generated by this reference voltage generation circuit 901 fluctuates according to the square root of the output current $I_{REF}$ of the current mirror unit 2. On the other hand, as one can see from Formula (17), the reference voltage $V_{REF}$ in the present embodiment is generated as a stable voltage that is independent of the current $I_P$.

In addition, by also providing MOSFET 10 that operates as a linear resistance and can generate a voltage having a positive temperature coefficient, the output of a constant reference voltage $V_{REF}$ in relation to temperature becomes possible even if the temperature coefficient of the combined voltage generating unit 8 is small, and this enables the scale of the circuit as a whole to be reduced.

Moreover, MOSFETs 8*a*, 8*b*, 8*c*, and 8*d* constituting the MOSFET pairs and MOSFET 9 operate in the subthreshold region since the gate terminals thereof are each connected to one of the third to fifth current output terminals $P_{C3}$, $P_{C4}$, and $P_{C5}$, and as a result it is not only possible to reduce the power consumption of the circuit, but by connecting each gate terminal to the output of the current mirror unit 2, each can easily be matched to the operating regions of the MOSFETs.

Figure 2:
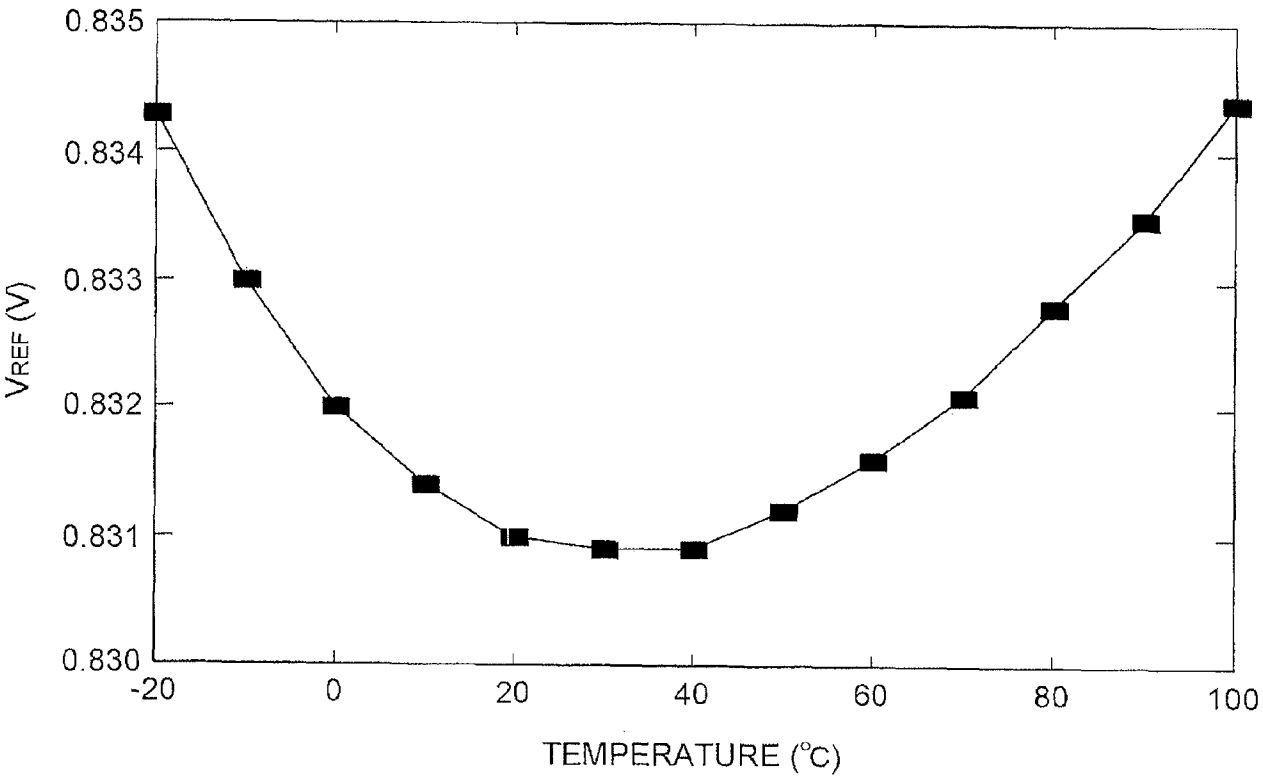
FIG. 2 is a graph showing simulation results of temperature properties of the reference voltage generated by the reference voltage generation circuit of FIG. 1.
Figure 3:
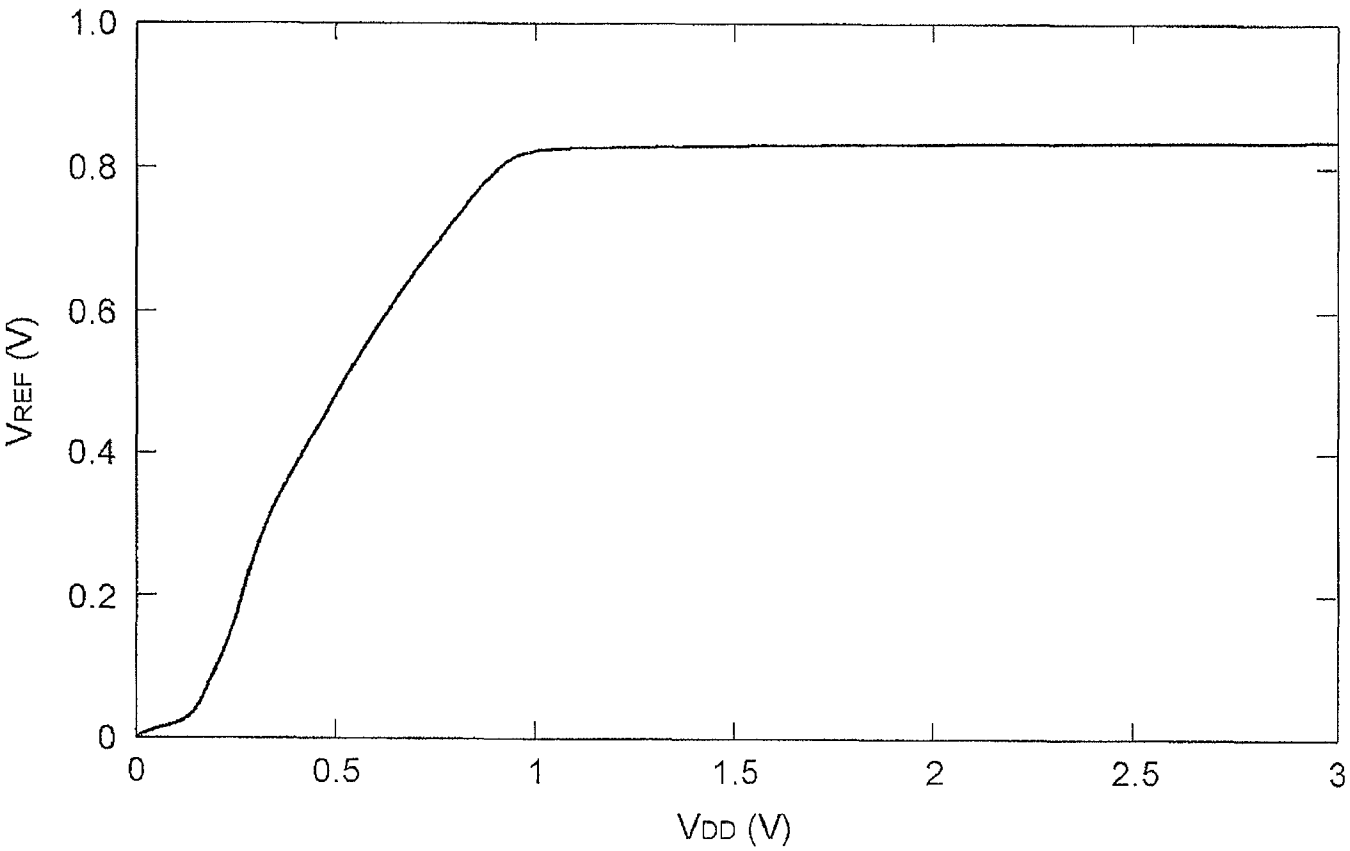
FIG. 3 is a graph showing the results of a source voltage-dependent simulation of the reference voltage generated by the reference voltage generation circuit of FIG. 1.

FIG. 2 is a graph showing the results of a simulation of temperature properties of the reference voltage $V_{REF}$ generated by the reference voltage generation circuit 1. FIG. 3 is a graph showing the results of a simulation of the dependency of the reference voltage $V_{REF}$ on the source voltage $V_{DD}$. At this time the size of each FET was set as follows: $K_1$=20, $K_2$=36, $K_3$=110, $K_4$=4, $K_5$=110, $K_6$=4, and $K_7$=4. From these results one can see that even if the temperature fluctuates in a range from −20° C. to 100° C., a reference voltage $V_{REF}$ averaging 830 mV is output within 0.4% error and a temperature independent, stable reference voltage is generated. Moreover, if the source voltage $V_{DD}$ is approximately 1 V or higher, it is clear that a stable reference voltage can be generated even if the source voltage changes.

Figure 4:
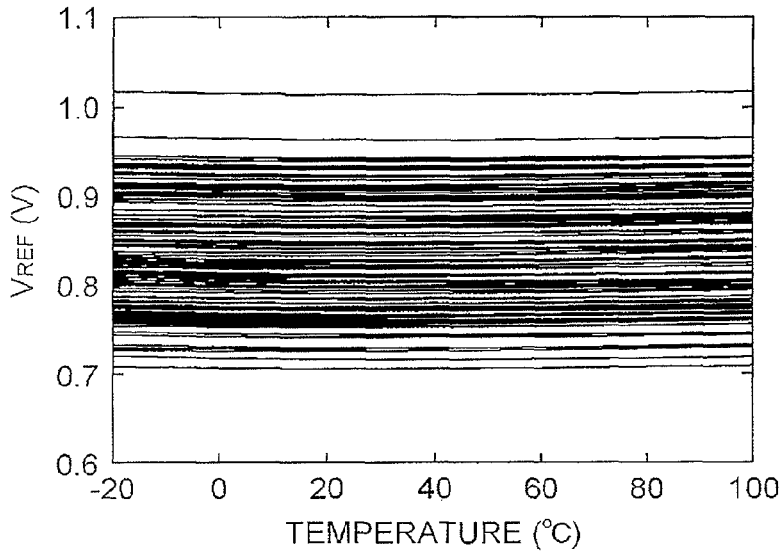
FIG. 4 is a graph showing the results of a temperature property simulation of the reference voltage generated by the reference voltage generation circuit of FIG. 1 when variations due to transistor process variations are taken into consideration.
Figure 4:
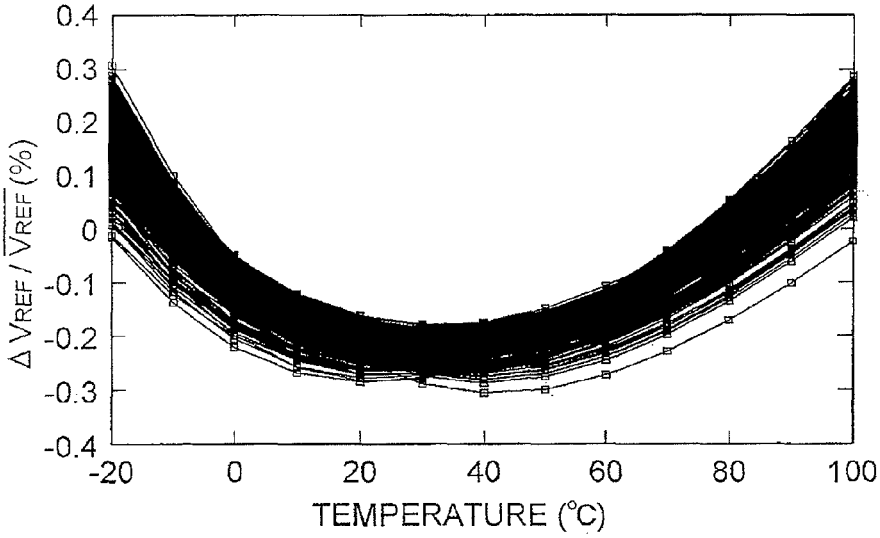

FIG. 4 shows the results of a simulation of the temperature properties of the reference voltage $V_{REF}$ when variations due to transistor process variations is taken into consideration. FIG. 4(*a*) is a graph showing the temperature properties of the reference voltage $V_{REF}$, and FIG. 4(*b*) is a graph showing the rate of change of the reference voltage $V_{REF}$ in relation to temperature $\Delta V_{REF}/V_{REF}$. Because the reference voltage generation circuit 1 is a threshold voltage-referring reference voltage source, the absolute value per se of the reference voltage $V_{REF}$ will change due to process variations, but it is clear that the fluctuation in relation to temperature is held to a sufficiently low level of within ±0.4%.

Figure 5:
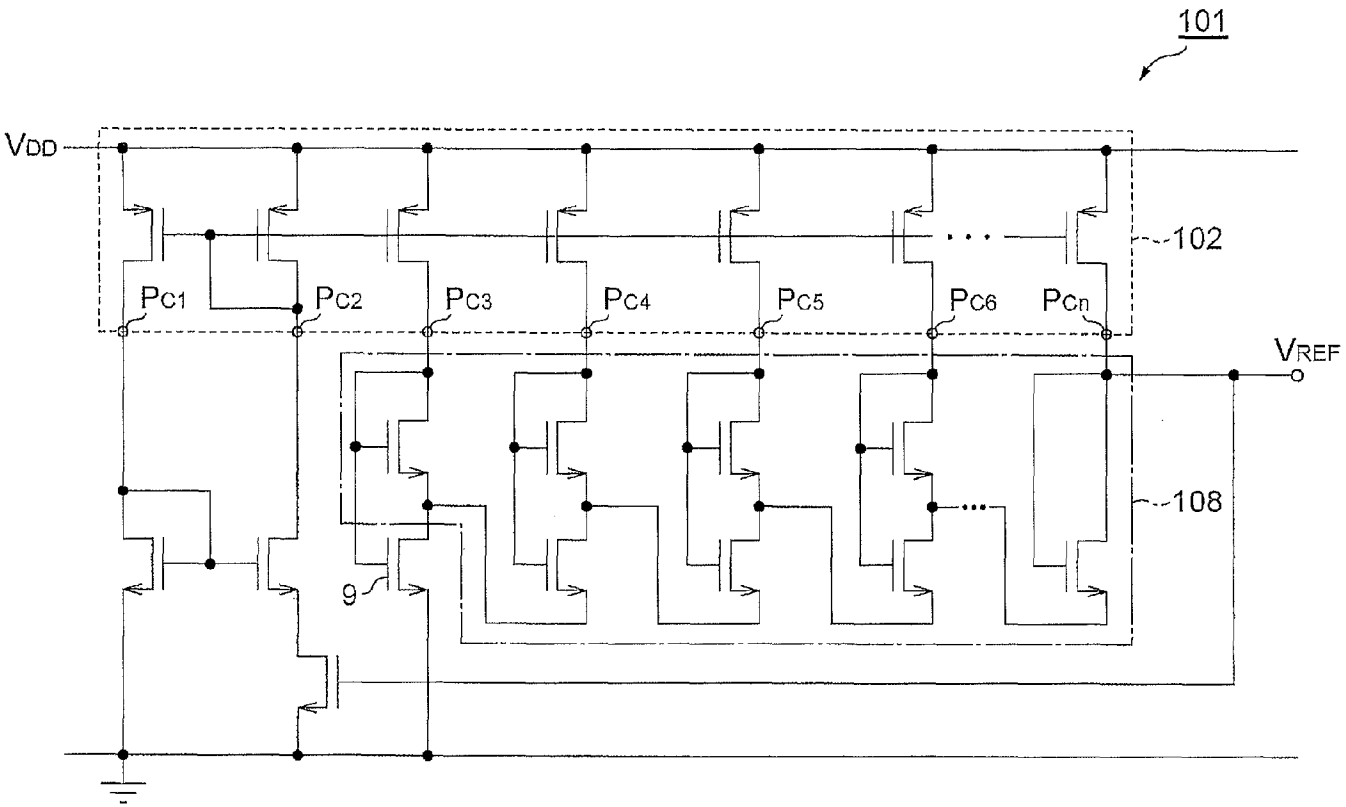
FIG. 5 is a circuit diagram showing the reference voltage generation circuit of a modified example of the present invention.

The present invention is not limited to the embodiment disclosed above. For example, the present invention can have a modified form such as that shown in FIG. 5. In other words, the reference voltage generation circuit 101 that is a modified example of the present invention shown in FIG. 5 comprises a current mirror unit 102 having n (wherein n is an integer of 4 or more) P-type MOSFETs and generating a current at the current output terminals $P_{C1}$ to $P_{Cn}$, a combined voltage generating unit 108 connected to the current output terminals $P_{C3}$ to $P_{Cn}$, and wherein n−3 groups of MOSFET pairs are connected in series, and MOSFET 9 connected to the current output terminals $P_{C3}$ to $P_{Cn}$ via the combined voltage generating unit 108. The number of steps n of the mirror current unit 102 is established as needed according to the value of the source voltage $V_{DD}$ and the size of each FET. In accordance with such a reference voltage generation circuit 101, it is possible to generate a reference voltage $V_{REF}$ that is stable in relation to temperature by combining a voltage having a positive temperature coefficient generated by the combined voltage generating unit 108 and a voltage having a negative temperature coefficient generated by MOSFET 9. In particular, by connecting the source terminal of MOSFET 9 directly to ground, it is possible to cancel out the substrate bias effect in MOSFET 9, so fluctuations in the reference voltage $V_{REF}$ can be reduced even more.

N-type transistors were used for MOSFETs 5*a*, 5*b*, 6*b*, 8*a*, 8*b*, 8*c*, 8*d*, 9, and 10 of the reference voltage generation circuit 1, but the circuit can also be realized with a circuit structure using P-type transistors.

Figure 6:
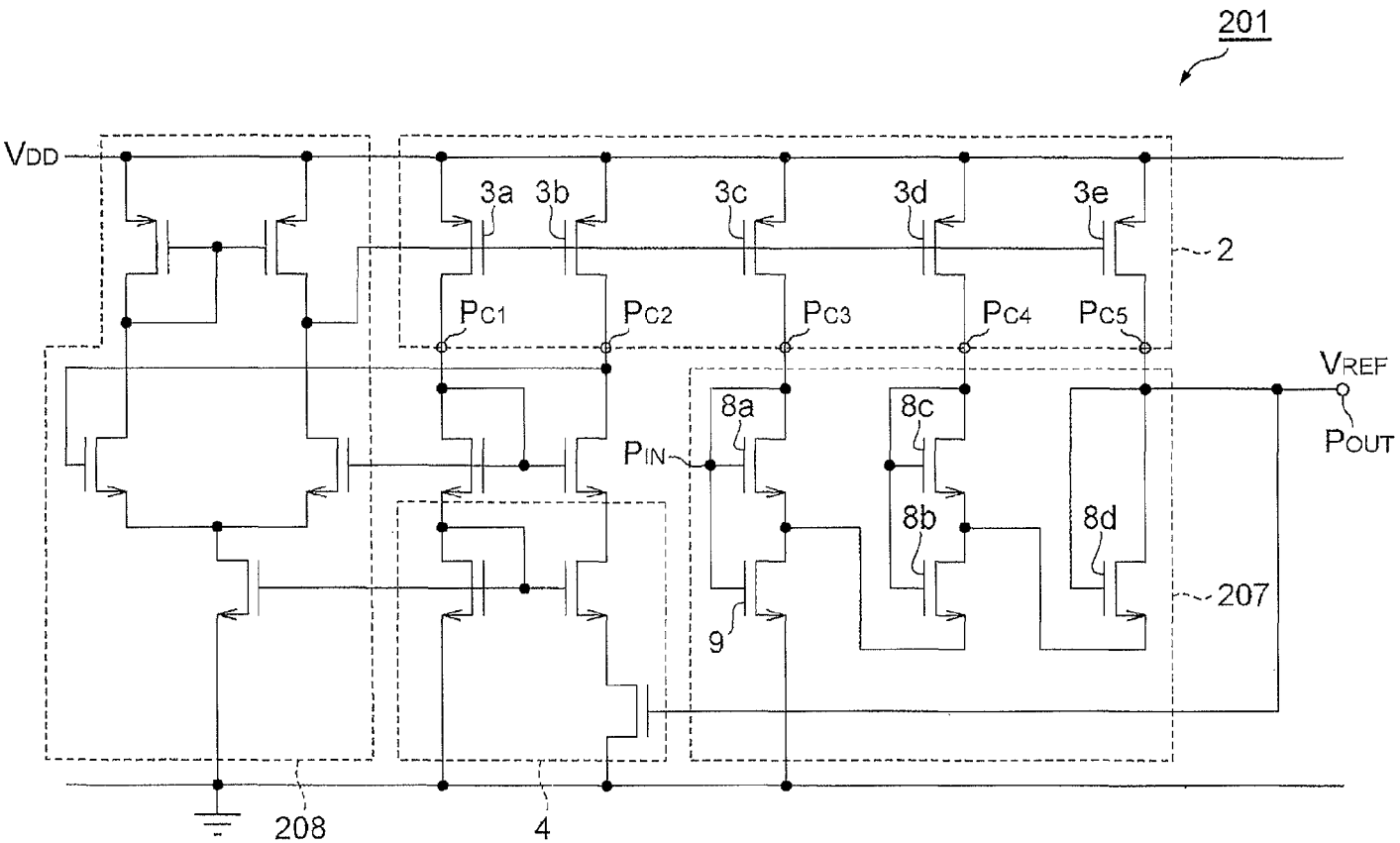
FIG. 6 is a circuit diagram showing the reference voltage generation circuit of a different modified example of the present invention.

In addition, the present invention can be used in a modified form such as the one shown in FIG. 6. More specifically, the reference voltage generation circuit 201 shown in that drawing can also comprise an op-amp 208 so that a stable current $I_F$ can be generated in the current mirror unit 2. In this op-amp 208, two input terminals are connected to the drain terminals of MOSFETs 3*a* and 3*b*, respectively, and the output terminals are connected in common to the gate terminals of MOSFETs 3*a* to 3*e*. By such a structure, even if the source voltage $V_{DD}$ fluctuates, because the drain voltages of MOSFETs 3*a* and 3*b* are stably held at the same value, it is possible to stabilize the current $I_F$ and obtain low voltage in the circuit. Additionally, in the reference voltage generation circuit 201, MOSFET 10 that operates in the strong inversion-linear region can also be eliminated. In other words, if MOSFET 10 is present, the source terminal of MOSFET 9 becomes greater than the ground voltage, and the threshold voltage of MOSFET 9 will vary slightly due to the substrate bias effect. When minimization of such an effect is desired, the source terminal of MOSFET 9 can be connected directly to ground.

Figure 7:
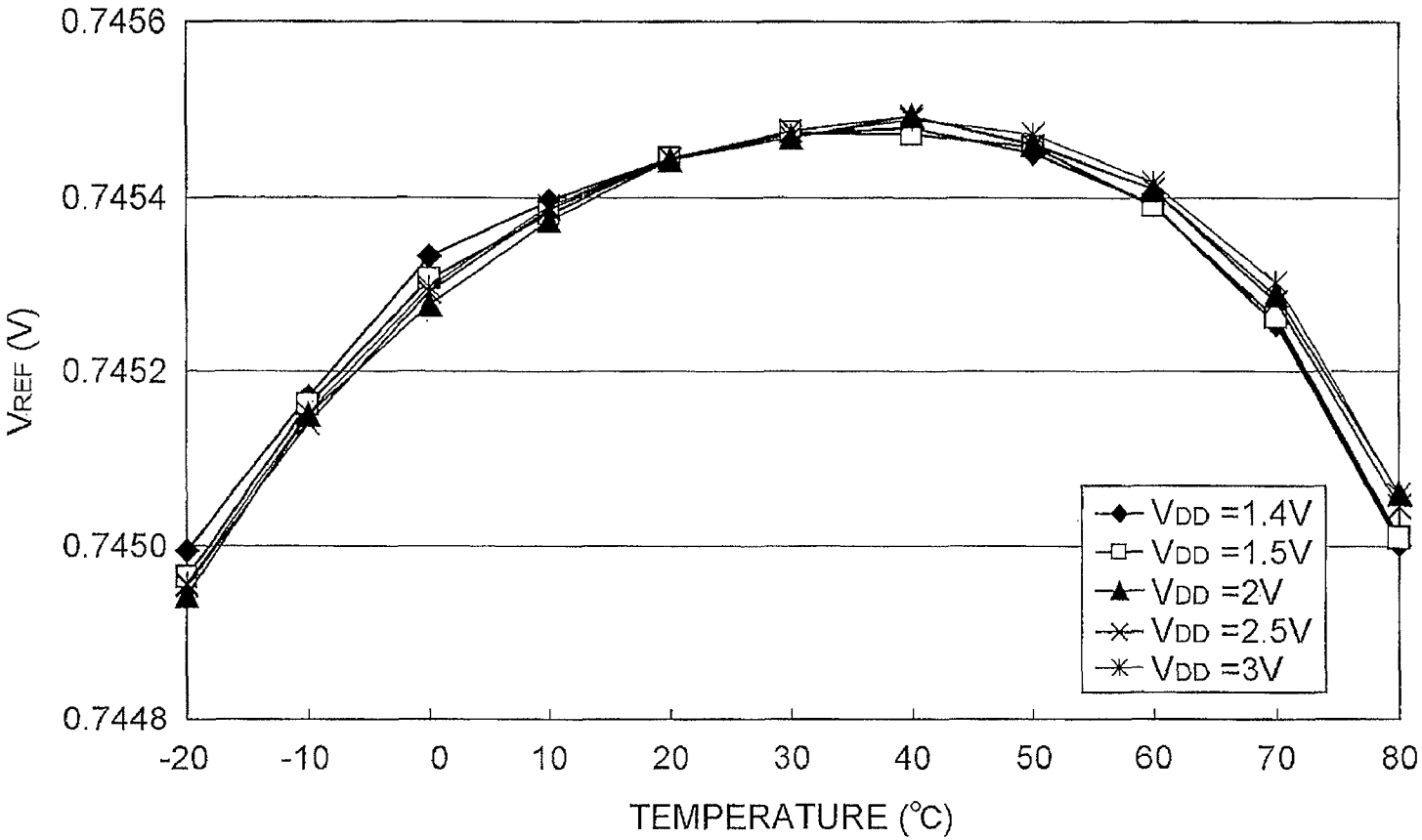
FIG. 7 is a graph showing the results of measurement of temperature properties of the reference voltage generated by the reference voltage generation circuit of FIG. 6.

FIG. 7 is a graph showing the measurement results of the temperature properties of the reference voltage $V_{REF}$ generated by the reference voltage generation circuit 201 in a case where the source voltage $V_{DD}$ is altered. For these measurement results, a reference voltage generation circuit 201 was actually fabricated on an LSI chip and used as the object of measurement. Based on these results, one can clearly see that a temperature independent, stable reference voltage was generated even when the source voltage $V_{DD}$ was altered in various ways.

Figure 8:
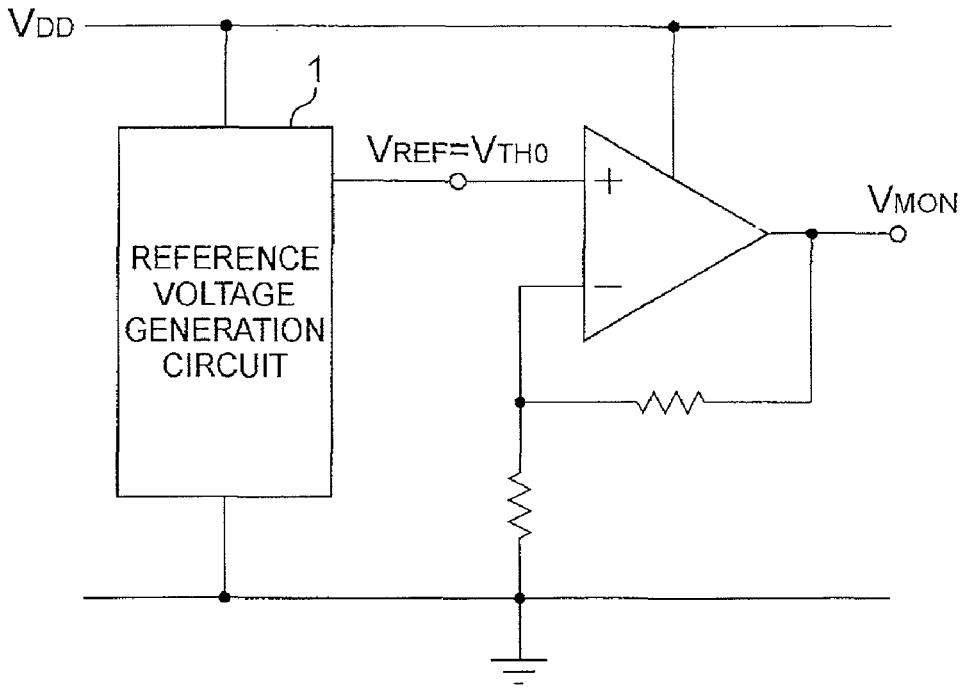
FIG. 8 is a circuit diagram showing a three-terminal regulator circuit of the application example of the present invention.

Finally, an application example of a reference voltage generation circuit 1 will be described. As shown in FIG. 8, the reference voltage generation circuit 1 can be used as a three-terminal regulator circuit for monitoring these threshold voltages in transistors caused by process variations. In other words, because the reference voltage $V_{REF}$, which is the output of the reference voltage generation circuit 1, expresses the threshold voltage $V_{TH0}$, process variations can be detected by monitoring this reference voltage with a monitor voltage $V_{MON}$.

The transistors constituting the field effect transistor pair and the second field effect transistor preferably operate in the subthreshold region by connection of each respective gate terminal to the third to Nth current output terminals. In such a case, it is possible to reduce power consumption of the circuit through operation of the field effect transistor pair and the second field effect transistor in the subthreshold region, and the operating region of each transistor can be easily matched by connecting the gate terminals of each to the output of the current mirror unit.

Furthermore, it is also preferable to provide a third field effect transistor that functions as linear resistance wherein the drain terminal thereof is connected to the second field effect transistor source terminal, the source terminal thereof is connected to ground, and the gate terminal thereof is connected to the reference voltage output terminal. By so doing, because a voltage having a relatively high positive temperature coefficient is generated between the drain terminal and the source terminal of the third field effect transistor, output of a constant reference voltage is possible even if the thermal coefficient of the combined voltage generating unit is small, and the scale of the circuit as a whole can be reduced thereby.

INDUSTRIAL APPLICABILITY

As an application of a reference voltage generation circuit, the present invention generates a stable reference voltage with respect to manufacturing process variations by matching the operating regions of MOSFETs contributing to generation of the reference voltage.

The invention claimed is:

1. A reference voltage generation circuit comprising:

a current mirror unit supplied with a source voltage and generating a current at first to Nth (wherein N is an integer of 4 or more) current output terminals;

a first field effect transistor operating as a linear resistance, and having a drain terminal connected to the second current output terminal side, a source terminal connected to ground side, and a gate terminal connected to a reference voltage output terminal;

a combined voltage generating unit having one or more field effect transistor pairs in which currents are generated at drain terminals from any of the third to Nth current output terminals, source terminals are mutually connected and a combined voltage with a positive temperature coefficient is generated between gate terminals, one gate terminal of the field effect transistor pairs being connected to an input side, the other gate terminal of the field effect transistor pairs being connected to the reference voltage output terminal side; and a second field effect transistor in which current is generated at a drain terminal from the third current output terminal, a gate terminal is connected to an input terminal of the combined voltage generating unit, a source terminal is connected on the ground side, and a voltage with a negative temperature coefficient is generated between the gate terminal and source terminal.

2. The reference voltage generation circuit according to claim 1, wherein the transistors constituting the field effect transistor pairs and the second field effect transistor operate in a subthreshold region by the respective gate terminals thereof being connected to the third to Nth current output terminals.

3. The reference voltage generation circuit according to claim 1, further comprising a third field effect transistor operating as a linear resistance, and having a drain terminal connected to the source terminal of the second field effect transistor, a source terminal connected to ground, and a gate terminal connected to the reference voltage output terminal.

4. The reference voltage generation circuit according to claim 1, wherein the first field effect transistor has the drain terminal connected to the second current output terminal side via a source from a fourth field effect transistor, the fourth field effect transistor having a gain connected to the first current output terminal and a drain connected to the second current output terminal.

* * * * *